US008152514B2

(12) United States Patent
Degenkolb et al.

(10) Patent No.: US 8,152,514 B2
(45) Date of Patent: Apr. 10, 2012

(54) OIL/SLURRY BURNER WITH INJECTION ATOMIZATION

(75) Inventors: Dietmar Degenkolb, Freiberg (DE); Norbert Fischer, Lichtenberg (DE); Christian Reuther, Freibeg (DE); Manfred Schingnitz, Freiberg (DE)

(73) Assignee: Siemens Aktiengesellschaft, Munich (DE)

( * ) Notice: Subject to any disclaimer, the term of this patent is extended or adjusted under 35 U.S.C. 154(b) by 212 days.

(21) Appl. No.: 12/151,746

(22) Filed: May 8, 2008

(65) Prior Publication Data

US 2008/0280241 A1 Nov. 13, 2008

(30) Foreign Application Priority Data

May 10, 2007 (DE) ..... 10 2007 021 926

(51) Int. Cl.

| | |
|---|---|
| ***F23C 5/00*** | (2006.01) |
| ***F23C 5/08*** | (2006.01) |
| ***F23L 9/00*** | (2006.01) |
| ***F23D 11/00*** | (2006.01) |
| ***F23N 5/00*** | (2006.01) |
| ***C01B 3/36*** | (2006.01) |

(52) U.S. Cl. ..... 431/174; 431/177; 431/190; 431/159; 431/6; 431/14; 431/12; 431/15; 431/181; 48/197 R

(58) Field of Classification Search ..... 431/168, 431/174, 177, 181, 190, 159, 44, 6, 14, 15; 110/189; 48/197 R, 206
See application file for complete search history.

(56) References Cited

U.S. PATENT DOCUMENTS

| | | | | |
|---|---|---|---|---|
| 3,256,842 | A * | 6/1966 | Vigneron et al. | 431/46 |
| 4,002,297 | A * | 1/1977 | Pillard | 239/429 |
| 4,351,645 | A * | 9/1982 | Marion et al. | 48/61 |
| 4,679,512 | A * | 7/1987 | Skoog | 110/347 |
| 4,881,949 | A * | 11/1989 | Brungel et al. | 48/197 R |
| 4,971,550 | A * | 11/1990 | Schingnitz et al. | 431/145 |
| 5,261,602 | A * | 11/1993 | Brent et al. | 239/132.3 |
| 5,443,620 | A * | 8/1995 | Kaasinen et al. | 75/629 |
| 5,451,160 | A * | 9/1995 | Becker | 431/284 |
| 5,964,166 | A * | 10/1999 | Alberti et al. | 110/261 |
| 6,007,325 | A * | 12/1999 | Loftus et al. | 431/8 |
| 6,652,267 | B1 * | 11/2003 | Brehm et al. | 431/160 |
| 6,755,355 | B2 * | 6/2004 | Whittaker | 239/132 |
| 7,762,200 | B2 * | 7/2010 | Fischer et al. | 110/347 |

FOREIGN PATENT DOCUMENTS

| | | |
|---|---|---|
| DE | 151 020 | 9/1981 |
| DE | 214 911 | 10/1984 |

* cited by examiner

*Primary Examiner* — Kenneth Rinehart
*Assistant Examiner* — William Corboy

(57) ABSTRACT

An oil/slurry burner with injection atomization for the gasification of solids-containing liquid fuels under high pressures of e.g. 80 bar (8 MPa) and high temperatures of e.g. 1200 to 1900 degrees centigrade in reactors with liquid slag removal is proposed, wherein a plurality of feeding elements disposed outside the annular duct concentrically with respect to the burner axis are provided for introducing liquid fuel and atomizing agent, the individual feeding elements being implemented intrinsically straight in the burner, inclined to the burner axis in the direction of the burner mouth, and ending at the burner mouth adjacent to the oxidant outlet. By introducing the liquid fuel and atomizing agent in individual completely implemented tubes with a corresponding nozzle, different fuels can be supplied simultaneously via the individual feeds and converted in a flame reaction.

12 Claims, 1 Drawing Sheet

OIL/SLURRY BURNER WITH INJECTION ATOMIZATION

CROSS REFERENCE TO RELATED APPLICATIONS

This application claims the benefits of German application No. 10 2007 021 926.3 filed May 10, 2007 and is incorporated by reference herein in its entirety.

FIELD OF INVENTION

The subject matter of the application relates to an oil/slurry burner with injection atomization for the gasification of solids-containing liquid fuels, a method for operating an oil/slurry burner and a method for starting up an oil/slurry burner.

The invention relates to an oil/slurry burner with injection atomization which is used for the steam-oxygen gasification of solids-containing liquid fuels (slurries or similar liquid fuels) under high pressures of e.g. 80 bar (8 MPa) and temperatures of e.g. 1200 to 1900° C. in reactors with liquid slag removal.

BACKGROUND OF THE INVENTION

Oil/slurry burners with injection atomization for partial oxidation of liquid fuels, comprising a cylindrical water-cooled housing and an internal liquid feed around which the atomizing agent and oxidant are supplied in coaxially disposed annuli, are well-known.

Said burners are started up either by a gas/air operated pilot burner disposed adjacent to the oil/slurry burner and equipped with an ionization flame monitoring device and ignition device, or, in the case of ceramic-lined reactors, by a separate heating burner which first brings to temperature the brickwork on which the oil/slurry burner is subsequently ignited.

The known burner has the following disadvantages:

Due to a centralized supply of liquid, use of the burner is restricted to a single fuel.

To start up the burner, another burner is required as a heating burner which is subsequently replaced, or a pilot burner disposed laterally adjacent to the oil/slurry burner must be present, in which case reliable lateral cross-ignition to the oil/slurry burner is questionable.

Startup of the oil/slurry burner takes place basically pressurelessly and under oxidizing atmosphere and must initially be carried over slowly to the reducing reactor atmosphere by means of complicated media adjustments before the actual gasification process can commence.

If after the heating process the brickwork temperature falls below the specified brickwork ignition temperature due to delay in the oil/slurry burner installation, the entire heating process must be repeated.

Such typical solutions are described in U.S. Pat. Nos. 151,020 and 214,911.

SUMMARY OF INVENTION

The object of the invention is to create an oil/slurry burner with injection atomization which operates reliably at pressure under the conditions of steam-oxygen gasification of solids-containing liquid fuels. It is aimed by means of constructional measures to implement an oil/slurry burner with injection atomization which compensates for the abovementioned disadvantages of pressurized gasification of solids-containing liquid fuels and ensures reliable operation with even flame spread.

This object is achieved in respect of a subject matter outlined by the features of the preamble by the features of the characterizing portion of the claims.

Advantageous developments of the subject matter of the application are set forth in the dependent claims.

BRIEF DESCRIPTION OF THE DRAWINGS

The subject matter of the application will now be explained in greater detail as an exemplary embodiment to the extent required for understanding and with reference to the accompanying drawings, in which.

In the figures, the same reference symbols are used to denote identical elements.

DETAILED DESCRIPTION OF INVENTION

Figure 1:
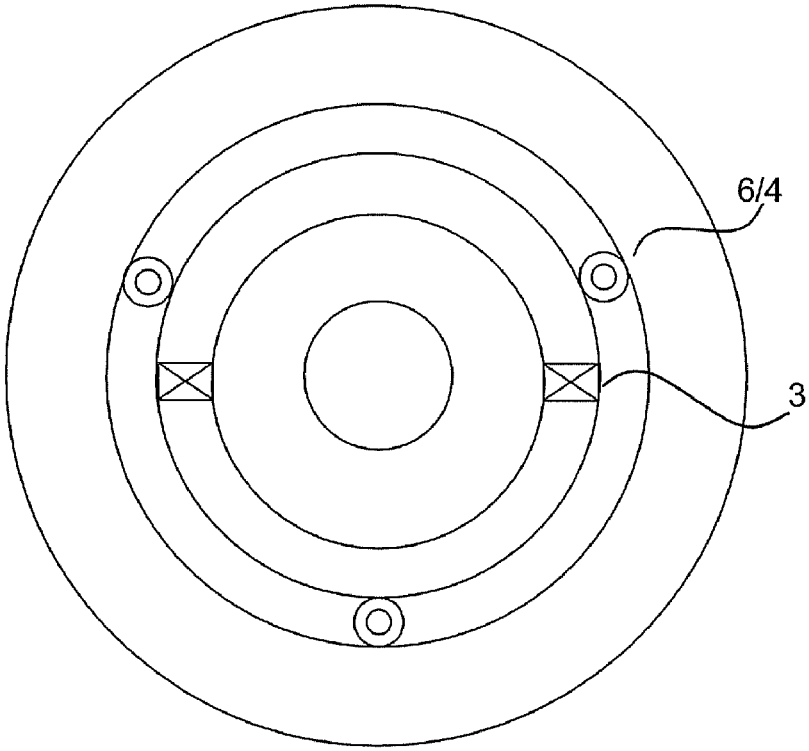
FIG. 1 shows an end view of the inventive oil/slurry burner.
Figure 2:
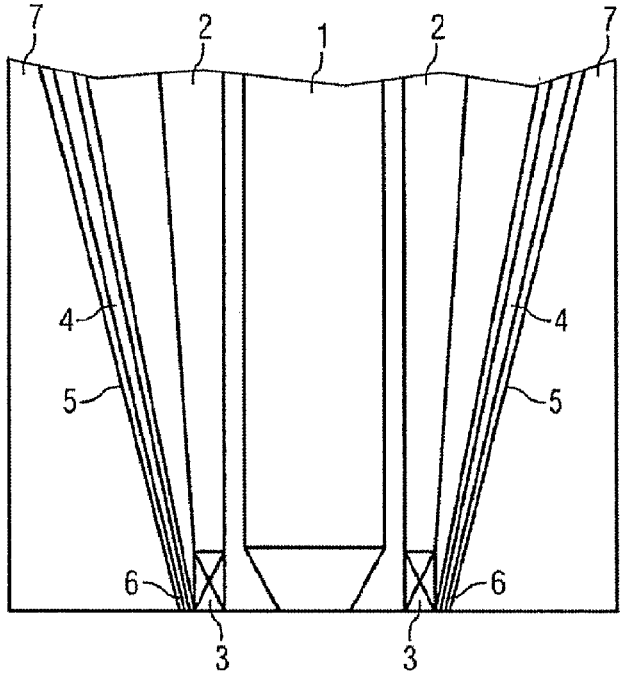
FIG. 2 shows a longitudinal section through the inventive oil/slurry burner with an annular feeding element and supply tubes disposed therein.

The inventive oil/slurry burner with injection atomization comprises a centrally disposed pilot burner section 1 with fuel gas and oxidant supply, a flame monitoring device and an electrical high-voltage ignition device. Disposed around said module is an annulus 2 for supplying the oxidant for the oil/slurry burner section. Swirl blades 3 for swirling the oxygen stream are disposed at the annular outlet port.

Both modules (pilot burner section and oxidant supply) are incorporated in another module, the burner holder 7. The entire burner holder module is implemented with a water cooling system in the form of a coiled tube in order to dissipate the heat acting on said module. In addition, the modules disposed in the center of the burner holder, the pilot burner section and additional oxidant supply, are also equipped with separate water cooling systems.

According to the invention provision is made for the liquid fuel and atomizing agent (steam or similar) to be supplied in such a way that a plurality (n=2, 3 . . . ) of straight fuel/steam feeding elements are disposed between the housing wall of the burner holder and the central oxidant supply. Said feeding elements are intrinsically straight and inclined to the burner axis and end at the burner mouth adjacent to the oxidant outlet in the form of an oil/atomizing agent nozzle. The atomizing agent (steam or similar) causes the solids-containing liquid fuel to be finely atomized before it comes into contact with the oxidant.

By implementing the oxidant supply using swirl blades, strong rotation is imparted to the discharging oxygen stream into which the atomized liquid jets discharging via the feeding elements are sucked.

At the outlet of the media the individual streams are mixed to produce a single rotating liquid/steam/oxygen stream. This ensures an even flame spread and stabilization.

At the same time the width and length of the flame spread can be influenced using different settings of the swirl blades.

By introducing the liquid fuel and atomizing agent in individual completely implemented tubes with a corresponding nozzle, different liquid fuels can be supplied simultaneously via the individual feeds and converted in a flame reaction.

The oil/slurry burner with injection atomization is started up by means of the integral pilot burner under reducing conditions and at reactor system operating pressure. The pilot burner is ignited at slight reactor pressure (2-5 bar) and likewise under reducing reaction chamber conditions.

The invention comprises an oil/slurry burner with injection atomization for the gasification of solids-containing liquid fuels (slurries or similar liquid fuels) under high pressures and temperatures in reactors with liquid slag removal for steam-oxygen gasification, having a cooled housing (7) for accommodating a centrally disposed pilot burner (1) used for starting up the oil/slurry burner unit and having a gas and oxidant supply as well as an integrated flame monitoring device and high-voltage ignition device, an annular duct (2) disposed around said pilot burner (1) for supplying the oxidant, and straight feeding elements (4 and 5) inclined to the burner axis for introducing liquid fuel and atomizing agent, characterized in that a plurality of feeding elements (4 and 5) are present and said feeding elements (4 and 5) are intrinsically straight and inclined to the burner axis and end at the outlet directly adjacent to the annular oxidant supply duct (2) in a nozzle (6) at whose outlet swirl devices (3) are provided which impart a strong rotating motion to the oxidant stream (2), thereby allowing the flame geometry to be influenced by suitable configuration.

The invention is also characterized in that, by means of the arrangement of a plurality of feeding elements (4 and 5), different liquid fuels can be introduced which end in a common flame and which are started up under reducing conditions and at reactor operating pressure by a pilot burner incorporated in the center.

The invention also relates to a method wherein a pilot burner incorporated in the center of the burner unit is ignited under reducing reactor atmosphere and at slightly elevated system pressure and then, as the pilot burner output increases, the reaction chamber pressure is raised to the operating pressure necessary for igniting the oil/slurry burner.

The invention claimed is:

1. An oil/slurry burner with injection atomization for the gasification of solids-containing liquid fuels, comprising:

a cooled housing, wherein a coiled tube provides cooling;

a pilot burner section centrally arranged in the cooled housing comprising a pilot burner passageway, comprising a separate pilot burner section cooling system;

an annular passageway arranged in the cooled housing concentric with the pilot burner passageway and comprising an annular passageway outlet disposed at a downstream end of the oil/slurry burner, where the annular passageway supplies an oxidant, wherein the annular passageway is cooled by a separate annular passageway cooling system;

a plurality of supply tubes concentrically arranged outside the annular passageway, wherein each of the supply tubes delivers a liquid fuel flow to a supply tube outlet disposed at the downstream end of the oil/slurry burner adjacent to and radially outward of the annular passageway outlet, wherein the individual supply tubes are implemented mutually straight and are inclined radially inward toward a longitudinal axis of the burner in a direction of the oil/slurry burner downstream end; and an atomizing agent feeding element that supplies an atomizing agent to the liquid fuel, comprising an atomizing agent feeding element outlet disposed at the downstream end of the oil/slurry burner;

wherein the annular passageway, the supply tubes, and the atomizing agent feeding element are configured to keep the oxidant, the liquid fuel flow, and the atomizing agent discrete from each other throughout the oil/slurry burner.

2. The oil/slurry burner as claimed in claim 1, wherein the atomizing agent feeding elements comprises an annular supply passageway, and the supply tubes are arranged in the annular supply passageway.

3. The oil/slurry burner as claimed in claim 2, wherein the annular supply passageway and the supply tube cross section narrow from the burner inlet to the oil/slurry burner downstream end.

4. The oil/slurry burner as claimed in claim 3, wherein the annular passageway has swirl devices that impart a rotating motion to the oxidant stream, thereby imparting a rotating motion to the single liquid-fuel/atomizing-agent/oxidant stream.

5. A method of operating an oil/slurry burner, comprising: providing a cooled housing, wherein a coiled tube provides cooling, the cooled housing having a pilot burner section centrally arranged in the cooled housing, wherein the pilot burner comprises a pilot burner passageway and a separate pilot burner section cooling system;

arranging an annular passageway in the cooled housing concentric with the pilot burner passageway and comprising an annular passageway outlet disposed at a downstream end of the oil/slurry burner, where the annular passageway supplies an oxidant and wherein the annular passageway is cooled by a separate annular passageway cooling system;

providing a plurality of supply tubes concentrically arranged outside the annular passageway, wherein each supply tube introduces a liquid fuel flow to a supply tube outlet disposed at the downstream end of the oil/slurry burner adjacent to and radially outward of the annular passageway outlet, wherein the individual supply tubes are implemented mutually straight and are inclined radially inward toward a longitudinal axis of the burner in a direction of the oil/slurry burner downstream end, and providing an atomizing agent feeding element that supplies an atomizing agent, wherein the supply tubes, the annular passageway, and the atomizing agent feeding element are configured to keep the oxidant, the liquid fuel flow, and the atomizing agent separate from each other throughout the oil/slurry burner.

6. The method as claimed in claim 5, wherein the atomizing agent feeding elements comprises an annular supply passageway, and the supply tubes are arranged in the annular supply passageway.

7. The method as claimed in claim 6, wherein the annular supply passageway and the supply tube cross sections narrow from the burner inlet to the oil/slurry burner downstream end.

8. The method as claimed in claim 7, wherein the annular passageway has swirl devices that impart a rotating motion to the oxidant stream, thereby imparting a rotating motion to the single liquid-fuel/atomizing-agent/oxidant stream.

9. A method for starting up an oil/slurry burner having a pilot burner passageway incorporated in the center of the oil/slurry burner, an annular passageway concentric with the pilot burner passageway and comprising an annular passageway outlet disposed at a downstream end of the oil/slurry burner wherein the annular passageway supplies an oxidant, a plurality of liquid fuel supply tubes disposed concentric with and radially outward of the annular passageway, each liquid fuel supply tube comprising a supply tube outlet disposed at the downstream end of the oil/slurry burner adjacent to and radially outward of the annular passageway outlet, wherein the liquid fuel supply tubes are angled radially inward toward a longitudinal axis of the burner, and a feeding element to supply atomizing agent, wherein the supply tubes, the atomizing agent feeding element, and the annular passageway are configured to keep the oxidant, the liquid fuel flow, and the atomizing agent separate from each other throughout the oil/slurry burner, the method comprising:

cooling the oil/slurry burner with a separate coiled tube;

cooling the pilot burner with a separate pilot burner cooling system cooling the annular passageway with a separate annular passageway cooling system;

igniting the pilot burner under reducing reactor atmosphere and at slightly elevated system pressure; and increasing a reaction pressure to the operating pressure necessary for igniting the oil/slurry burner, as the pilot burner output increases.

10. The method as claimed in claim 9, wherein the atomizing agent feeding elements comprise an annular supply passageway, and the supply tubes are arranged in the annular supply passageway.

11. The method as claimed in claim 10, wherein the annular supply passageway and the supply tube cross sections narrow from the burner inlet to the oil/slurry burner downstream end.

12. The method as claimed in claim 11, wherein the annular passageway has swirl devices that impart a rotating motion to the oxidant stream, thereby imparting a rotating motion to the single liquid-fuel/atomizing-agent/oxidant stream.

* * * * *